US006517160B2

(12) United States Patent
Marcantoni

(10) Patent No.: US 6,517,160 B2
(45) Date of Patent: Feb. 11, 2003

(54) EXTENSIBLE FOOTREST, PARTICULARLY FOR ARMCHAIRS, SOFAS AND THE LIKE

(75) Inventor: Egidio Marcantoni, Pesaro (IT)

(73) Assignee: Ciar S.p.A, Borgo S. Maria (IT)

( * ) Notice: Subject to any disclaimer, the term of this patent is extended or adjusted under 35 U.S.C. 154(b) by 0 days.

(21) Appl. No.: 09/775,509

(22) Filed: Feb. 5, 2001

(65) Prior Publication Data

US 2001/0022461 A1 Sep. 20, 2001

(30) Foreign Application Priority Data

Mar. 17, 2000 (IT) ..... MI2000A000571

(51) Int. Cl.[7] ..... A47C 7/50

(52) U.S. Cl. ..... 297/423.36; 297/423.28; 297/423.3; 297/423.31; 297/423.32

(58) Field of Search ..... 297/423.3, 423.31, 297/423.32, 423.36, 423.29

(56) References Cited

U.S. PATENT DOCUMENTS

| | | | | | |
|---|---|---|---|---|---|
| 156,004 | A | * | 10/1874 | Wayland | 297/423.3 |
| 777,941 | A | * | 12/1904 | Fontes | 297/68 |
| 4,635,999 | A | * | 1/1987 | Simpson | 297/88 |
| 4,878,709 | A | * | 11/1989 | Okamoto | 297/68 |
| 5,033,793 | A | | 7/1991 | Quintile | |
| 5,507,562 | A | * | 4/1996 | Wieland | 297/423.2 |
| 5,755,493 | A | | 5/1998 | Kodaverdian | |
| 6,030,033 | A | | 2/2000 | Schultz | |
| 6,095,610 | A | * | 8/2000 | Okajima et al. | 297/423.36 |

FOREIGN PATENT DOCUMENTS

DE 34 24 284 A 3/1985

* cited by examiner

*Primary Examiner*—Peter M. Cuomo
*Assistant Examiner*—Joseph Edell
(74) *Attorney, Agent, or Firm*—Guido Modiano; Albert Josif; Daniel O'Byrne

(57) ABSTRACT

An extensible footrest, particularly for armchairs, sofas and the like, which comprises a frame adapted to be hinged to a frame of a seat of an armchair, sofa or the like, the footrest frame being constituted by a first pair of lateral arms and by a second pair of lateral arms which are slideable with respect to the first pair of lateral arms, at least one actuator being rigidly connected to the seat frame at one end and to the footrest frame at an opposite end, in order to transfer the footrest frame from a first retracted inactive position to an extended active position.

6 Claims, 3 Drawing Sheets

EXTENSIBLE FOOTREST, PARTICULARLY FOR ARMCHAIRS, SOFAS AND THE LIKE

BACKGROUND OF THE INVENTION

The present invention relates to an extensible footrest, particularly for armchairs, sofas and the like.

More particularly, the invention relates to an extensible footrest with high operating safety.

Conventional sofas, armchairs and the like have an extensible footrest which allows the user to comfortably stretch out his legs being supported by the extensible footrest which moves from an inactive position, in which it is substantially adjacent to the edge of the armchair or sofa, and against which the calves of the user rest, to an active position, in which the footrest is substantially horizontal with respect to the ground and horizontally supports the user's legs.

Conventional footrests are generally provided with an extension mechanism which is known as scissors-type opening. This solution is widely used owing to its manufacturing simplicity and to the gradual and effective extension that it can ensure for the footrest.

In particular, the extension mechanism relies on arms which are provided on either side of the footrest, connect the footrest to the frame of the armchair or sofa, and move according to a substantially pantograph- or scissorlike configuration, however with the drawback that gaps form between them during opening and closure movements with possible danger for the user.

If the user inadvertently inserts a finger in such gaps, the result may in fact be severe injury due to the folding movement of the arms onto each other, consequently eliminating the previously created gaps.

This drawback is even more severe if the users are children, who have limited perception of danger.

SUMMARY OF THE INVENTION

The aim of the present invention is to provide an extensible footrest, particularly for armchairs, sofas and the like, having a movement mechanism which avoids creating dangers for the safety of users.

Within the scope of this aim, an object of the present invention is to provide an extensible footrest, particularly for sofas, armchairs and the like, in which the footrest extension mechanism ensures, in addition to a substantially complete lack of dangers for users, a smooth and gradual extension and folding movement.

Another object of the present invention is to provide an extensible footrest, particularly for armchairs, sofas and the like, whose overall dimensions are substantially comparable to those of conventional extension mechanisms.

Another object of the present invention is to provide an extensible footrest, particularly for armchairs, sofas and the like, which is highly reliable, relatively simple to manufacture and at competitive costs.

These and other objects which will become better apparent hereinafter are achieved by an extensible footrest, particularly for armchairs, sofas and the like, characterized in that it comprises a frame which is adapted to be hinged to a frame of a seat of an armchair, sofa or the like, said footrest frame being constituted by a first pair of lateral arms and by a second pair of lateral arms which are slideable with respect to said first pair of lateral arms, at least one actuator being rigidly connected to said seat frame at one end and to said footrest frame at an opposite end, in order to transfer said footrest frame from a first retracted inactive position to an extended active position.

BRIEF DESCRIPTION OF THE DRAWINGS

Further characteristics and advantages of the invention will become better apparent from the following detailed description of a preferred but not exclusive embodiment of the footrest according to the invention, illustrated only by way of non-limitative example in the accompanying drawings, wherein.

DESCRIPTION OF THE PREFERRED EMBODIMENTS

Figure 1:
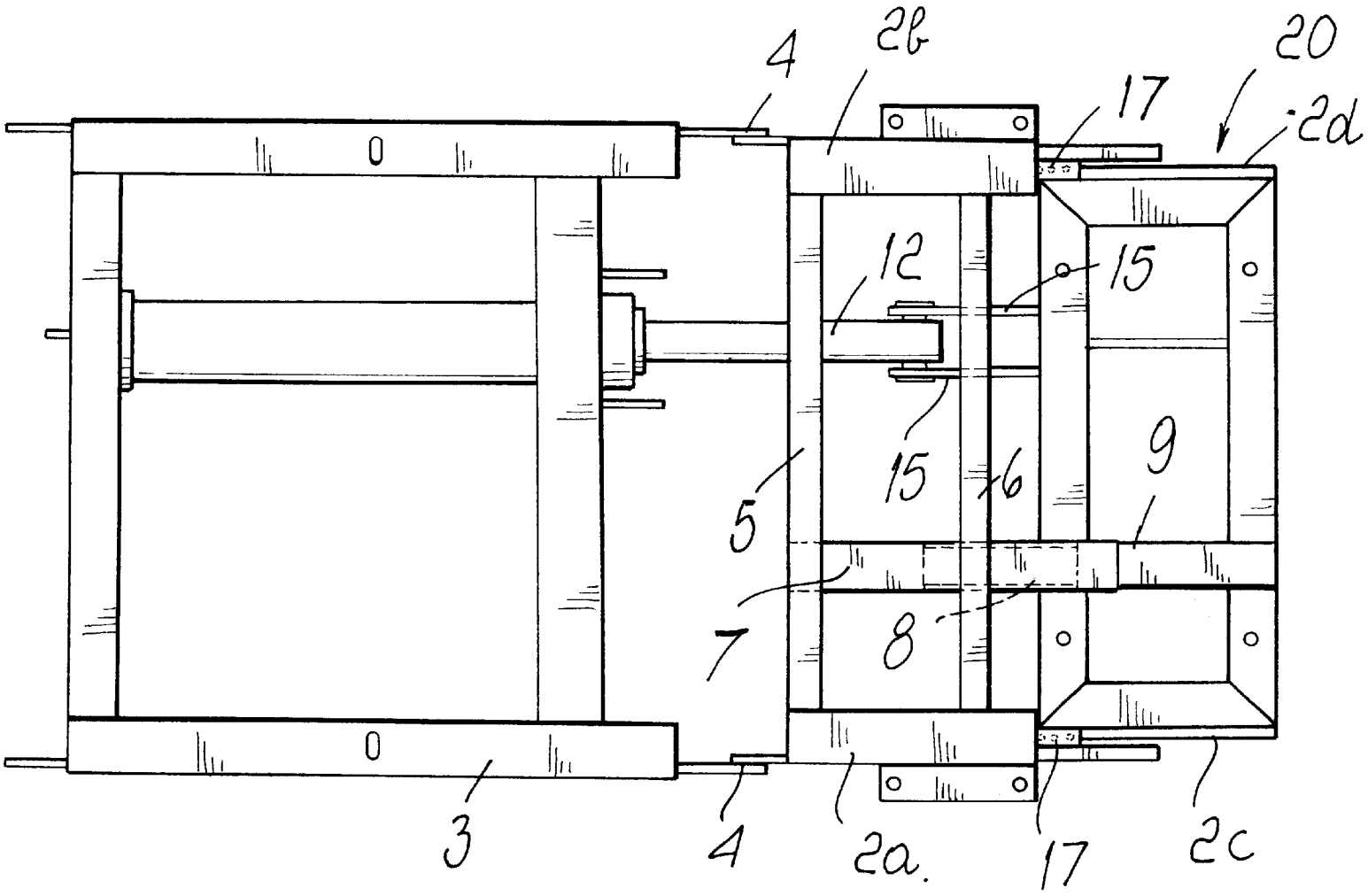
FIG. 1 is a plan view of an extensible footrest according to the invention, connected to the frame of an armchair or sofa, in the closure position.
Figure 2:
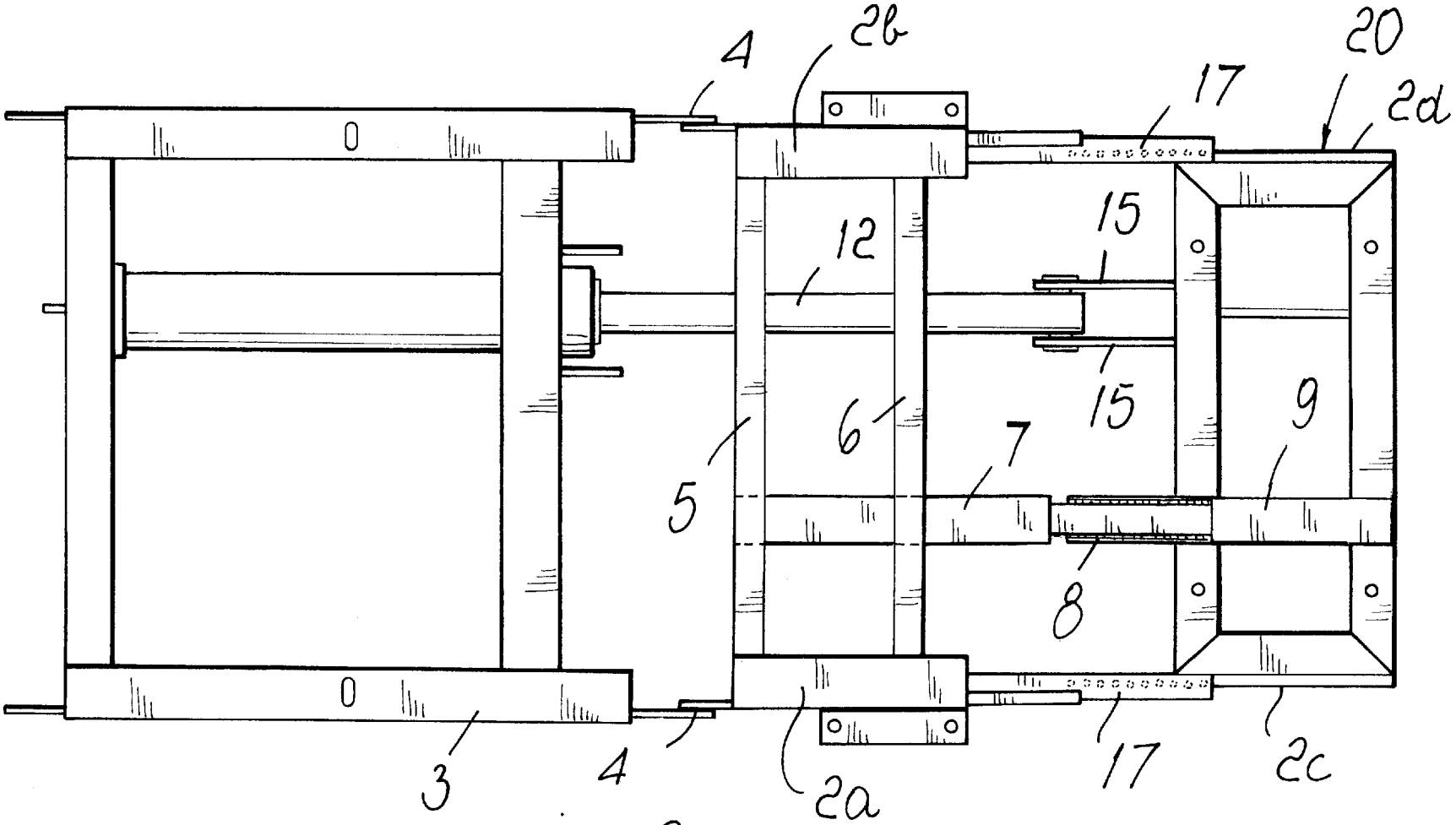
FIG. 2 is a plan view of the extensible footrest according to the invention the fully open configuration.

With reference to the figures, the extensible footrest according to the invention comprises a substantially rectangular frame 1 which is formed by two lateral arms 2*a* and 2*b* in which two additional arms, designated by the reference numerals 2*c* and 2*d* respectively, slide telescopically and allow to provide an extension of the footrest.

Conveniently, the arms 2*a* and 2*b* are pivoted to a frame 3 that constitutes the fixed seat structure of the armchair or sofa.

The pivoting point is designated by the reference numeral 4 in the figures.

Conveniently, the arms 2*a* and 2*b* are connected by cross-members 5 and 6, while an additional arm 7, rigidly coupled to the cross-members 5 and 6 and arranged substantially at right angles thereto, is provided with sliding means 8 which are also provided for telescopic coupling between the arms 2*a*, 2*b*, 2*c* and 2*d*, respectively.

The sliding means 8 allow an arm 9, which is rigidly coupled to the footrest portion delimited by the arms 2*c* and 2*d*, to slide in engagement within the arm 7, parallel to the sliding of the arms 2*c* and 2*d* within the arms 2*a* and 2*b*.

An actuator 12, rigidly coupled to the seat frame 3 of the armchair or sofa in a downward region thereof, is provided with a stem 13 pivoted at a point 14 to a fork 15 which is rigidly coupled to the end portion of the footrest formed by the pair of lateral arms 2*c* and 2*d* and by the internal arm 9.

Conveniently, the respective stem 13 of the actuator 12 rests against a bush or roller 16, preferably made of nylon, which allows a smooth extension of the stem 13 of the actuator 12.

The presence of the actuator 12 and of the extensible arms allows to move the footrest 2 into the active position and simultaneously fully extend the footrest, so as to provide a support for the legs of the user.

As clearly noticeable, the sliding means 8, together with the sliding elements 17 that are present at the arms 2*c* and 2*d*, in addition to allowing the telescopic sliding of the arms with respect to the arms 2*a* and 2*b*, also allow to perform a translatory motion of the end portion of the footrest, designated by the reference numeral 20, with respect to the footrest portion formed by the arms 2*a*, 2*b* and by the cross-members 5 and 6.

In this manner, both extension and retraction of the extensible footrest 2 does not cause the formation of dangerous gaps in which the user's hands can accidentally be inserted.

The footrest according to the invention ensures, by means of the actuator 12, a smooth and gradual sliding although being devoid of the drawbacks that affect conventional footrests.

Conveniently, the sliding elements are constituted by guides which are formed laterally to the arms 2*c*, 2*d* and 9 and allow a gradual sliding of said arms within the arms 2*a*, 2*b* and 7 respectively.

Figure 3:
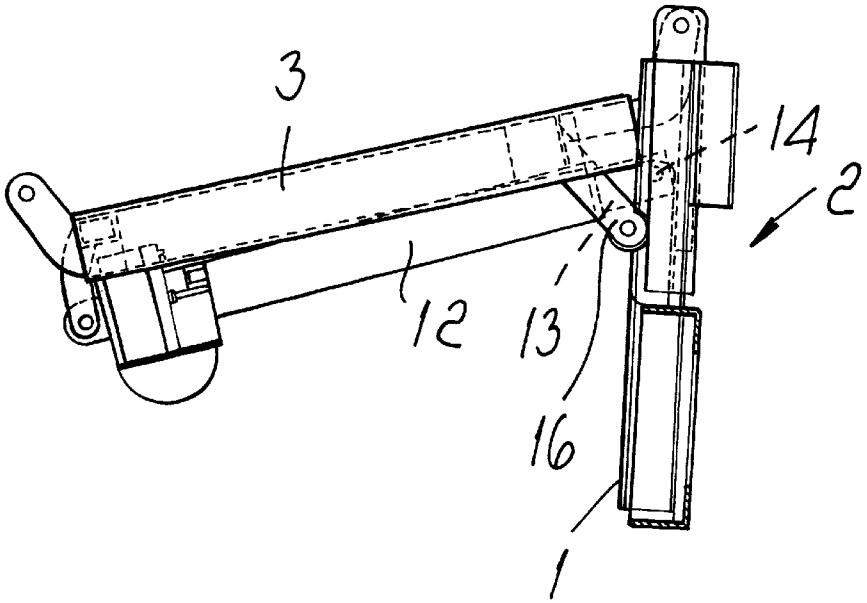
FIG. 3 is a side view of the footrest according to the invention in the closed position.
Figure 4:
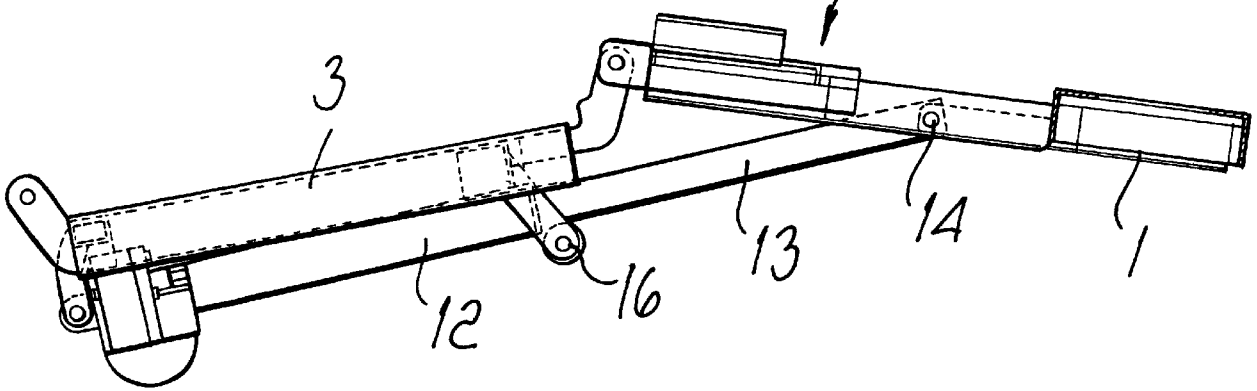
FIG. 4 is a side view of the footrest according to the invention in the fully open position.

FIG. 3 illustrates the extensible footrest according to the invention in a fully retracted position, while FIG. 4 illustrates the footrest in a fully extended configuration in which the footrest 2 is substantially parallel to the ground, with an angle which can be conveniently between for example 5 and 10° below the horizontal. However, the angle can of course be different according to requirements and to the particular use of the footrest.

It should also be noted that the pivoting points of the end of the actuator that is rigidly coupled to the frame of the seat and for the pivoting of the footrest frame to the seat frame remain in the same relative position as the angle between a longitudinal axis of the frame of the footrest and a longitudinal axis of the frame of the seat varies.

In practice it has been observed that the footrest according to the invention fully achieves the intended aim and objects, since it can be extended and retracted with a smooth and controlled movement without creating dangerous situations for the user, forming gaps between the opening mechanism within which the hand or finger of the user can accidentally be inserted, with consequent danger.

The footrest thus conceived is susceptible of numerous modifications and variations, all of which are within the scope of the inventive concept; all the details may furthermore be replaced with other technically equivalent elements.

In practice, the materials used, so long as they are compatible with the specific use, as well as the dimensions, may be any according to requirements and to the state of the art.

The disclosures in Italian Patent Application No. MI2000A000571 from which this application claims priority are incorporated herein by reference.

What is claimed is:

1. An extensible footrest, particularly for armchairs, sofas, comprising a frame which is adapted to be hinged to a frame of a seat of an armchair, sofa, said footrest frame being constituted by a first pair of lateral arms and by a second pair of lateral arms which are slideable with respect to said first pair of lateral arms, at least one actuator being rigidly connected to said seat frame at one end and to said footrest frame at an opposite end, in order to transfer said footrest frame from a first retracted inactive position to an extended active position, said at least one actuator being supported by at least one supporting roller arranged below the frame of the seat and below the actuator, said roller providing a smooth extension and retraction movements of the actuator, said roller defining a supporting guide for said actuator, the roller being constantly in contact with said actuator and being always in a same position throughout the whole extension and retraction movements.

2. The footrest according to claim 1, wherein each arm of said second pair of lateral arms has guides for sliding in engagement with said first pair of lateral arms.

3. The footrest armoring to claim 1, wherein said arms of said first pair of lateral arms are connected to one another by cross-members, an additional arm, arranged parallel to said first pair of lateral arms, being adapted to engage a further arm arranged parallel to said second pair of lateral arms and in line with said additional arm, said additional aim and said further arm being arranged inside a region delimited by said second pair of lateral arms.

4. The footrest according to claim 3, wherein the engagement between said additional arm that is parallel to said first pair of arms and said further arm that is parallel to said second pair of arras is provided by means of sliding guides.

5. The footrest according to claim 1, wherein a stem of said at least one actuator is supported, in the extension and retraction movement, by said at least one supporting roller.

6. The footrest according to claim 1, wherein pivoting points of the end of said actuator that is rigidly coupled to said seat frame and pivoting points of said footrest frame to said seat frame remain in the same relative position as the angle between a longitudinal axis of said footrest frame and a longitudinal axis of said seat frame varies.

* * * * *